US009154884B2

(12) United States Patent
Yan

(10) Patent No.: US 9,154,884 B2
(45) Date of Patent: Oct. 6, 2015

(54) ELECTRO-ACOUSTIC TRANSDUCER

(71) Applicant: Xudong Yan, Shenzhen (CN)

(72) Inventor: Xudong Yan, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/446,902

(22) Filed: Jul. 30, 2014

(65) Prior Publication Data

US 2015/0086066 A1 Mar. 26, 2015

(30) Foreign Application Priority Data

Sep. 25, 2013 (CN) ..... 2013 2 0593780 U

(51) Int. Cl.
*H04R 9/02* (2006.01)

(52) U.S. Cl.
CPC ..... *H04R 9/025* (2013.01); *H04R 2209/022* (2013.01); *H04R 2400/03* (2013.01)

(58) Field of Classification Search
CPC ..... H04R 9/00; H04R 9/02; H04R 9/025; H04R 2209/022; H04R 2209/024; H04R 2499/11
USPC ..... 381/396, 400, 412, 414, 420, 421, 422
See application file for complete search history.

(56) References Cited

U.S. PATENT DOCUMENTS 3,413,579 A * 11/1968 Sloan ..... 335/231
4,933,975 A * 6/1990 Button ..... 381/397
6,341,167 B1 * 1/2002 Okuyama et al. ..... 381/407
6,774,510 B1 * 8/2004 Moro et al. ..... 310/12.24
7,031,489 B2 * 4/2006 Amino ..... 381/414
7,653,209 B2 * 1/2010 Abe et al. ..... 381/414
7,894,623 B2 * 2/2011 Mihelich et al. ..... 381/412
8,170,267 B2 * 5/2012 Kim et al. ..... 381/396
8,270,661 B2 * 9/2012 Sorensen et al. ..... 381/421
8,290,201 B2 * 10/2012 Kamimura et al. ..... 381/423
8,379,904 B2 * 2/2013 Liu et al. ..... 381/400
8,553,926 B2 * 10/2013 Takewa ..... 381/398
8,577,075 B2 * 11/2013 Yan ..... 381/407
8,630,441 B2 * 1/2014 Shi et al. ..... 381/398
8,649,550 B2 * 2/2014 Shi et al. ..... 381/421
8,660,292 B2 * 2/2014 Li et al. ..... 381/412
2004/0136561 A1 * 7/2004 Wang ..... 381/423
2006/0222199 A1 * 10/2006 Abe et al. ..... 381/396
2007/0147652 A1 * 6/2007 Takayama et al. ..... 381/396
2007/0165902 A1 * 7/2007 Matsumura et al. ..... 381/396
2012/0170792 A1 * 7/2012 Li et al. ..... 381/412
2012/0177245 A1 * 7/2012 Shi et al. ..... 381/398
2012/0177246 A1 * 7/2012 Shi et al. ..... 381/398
2013/0016874 A1 * 1/2013 Huang et al. ..... 381/433
2013/0279737 A1 * 10/2013 Jiang et al. ..... 381/412
2014/0254858 A1 * 9/2014 He ..... 381/398
2015/0023506 A1 * 1/2015 Jansson ..... 381/17

* cited by examiner

*Primary Examiner* — Curtis Kuntz
*Assistant Examiner* — Joshua A Kaufman
(74) *Attorney, Agent, or Firm* — IPro, Inc.; Na Xu

(57) ABSTRACT

An electro-acoustic transducer includes a frame, a magnet circuit unit accommodated in the frame, and a vibration unit engaging with the frame. The magnetic circuit unit includes a lower plate, a main magnet positioned centrally on the lower plate, a pair of auxiliary magnets positioned spaced from the main magnet for forming a magnetic gap, and a pair of upper plates attached to the auxiliary magnets, respectively. Each upper plate includes a base body integrated with the frame, and a restricting part extending from the base body and engaging with an inner surface of the auxiliary magnet facing the main magnet.

10 Claims, 6 Drawing Sheets

ELECTRO-ACOUSTIC TRANSDUCER

FIELD OF THE INVENTION

The present invention relates to the art of electro-acoustic transducers, more particularly to a speaker having an improved magnetic circuit unit.

DESCRIPTION OF RELATED ART

With the rapid development of wireless communication technologies, portable electronic devices are widely used. Users require portable electronic devices to not only have voice function, but also have high quality acoustic performance. A portable electronic device also provides the users with entertainment contents, such as music, video, game, and so on. For converting electrical signals into audible sounds, a speaker is a necessary component used in the portable electronic device for generating sounds. With the portable electronic device, such as a mobile phone, designed to be smaller and smaller, the speaker used therein is also required to have a low profile with small size.

An electro-acoustic transducer related to the present disclosure includes a lower plate, a main magnet positioned on a central portion of the lower plate, a pair of auxiliary magnets positioned away from two sides of the main magnet and a pair of upper plates attached on upper surfaces of the auxiliary magnets, respectively. A magnetic gap is accordingly formed between the main magnet and the auxiliary magnets for partially receiving a voice coil. The magnets, including the main magnet and the auxiliary magnets, are all attached to the lower plate by adhesive, or soldering. When the magnets are magnetized, powerful attraction force is produced between the main magnet and the auxiliary magnets. Once the attraction force is greater than the adhesive force between the auxiliary magnet and the lower plate, the auxiliary magnets will be attracted to the main magnet, and then the auxiliary magnets will conflict with the voice coil. The confliction between the auxiliary magnets and the voice coil will badly affect the acoustic performance of the electro-acoustic transducer.

Therefore, it is desirable to provide an improved electro-acoustic transducer which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

Figure 1:
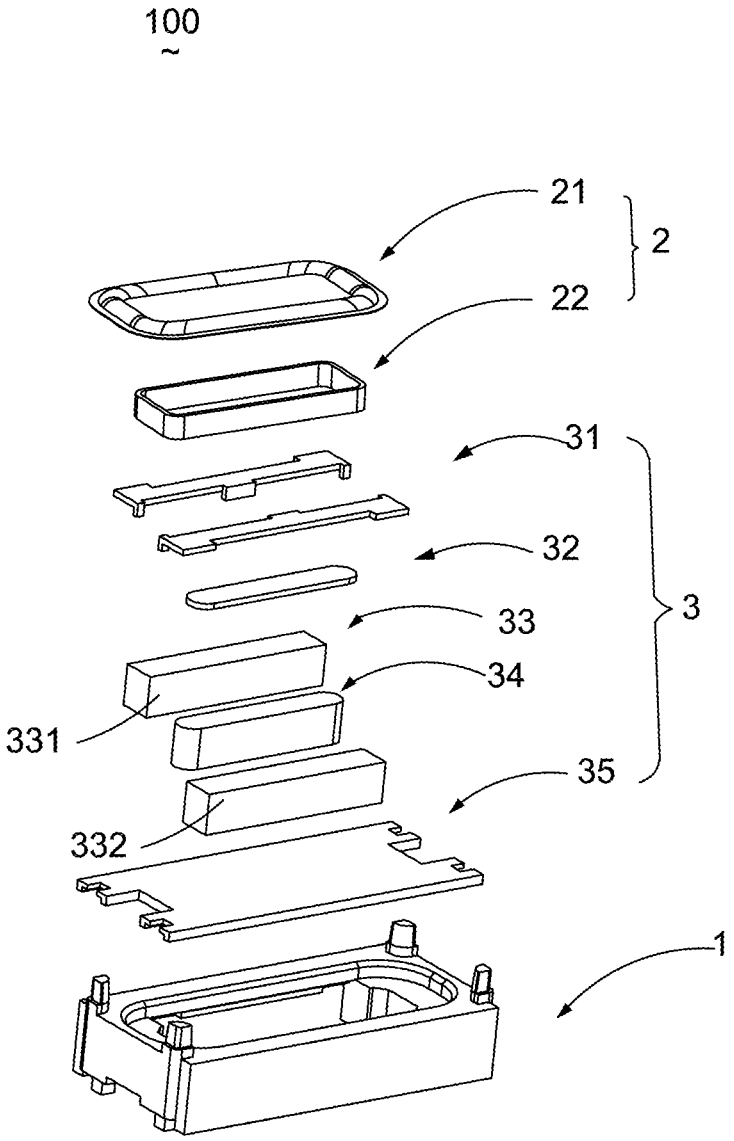
FIG. 1 is an exploded view of an electro-acoustic transducer according to a first embodiment of the present invention.

Referring to FIG. 1, an electro-acoustic transducer 100 according to a first embodiment, comprises a frame 1, a vibration unit 2 fixed to the frame 1, a magnetic circuit unit 3 accommodated in the frame 1. The vibration unit 2 is fixed to the frame 1 in this embodiment. In fact, it could also be fixed to the magnetic circuit unit 3.

The vibration unit 2 includes a voice coil 22 and a diaphragm 21 connected with the voice coil 22. The diaphragm 21 is made from stretchable and soft material.

Figure 2:
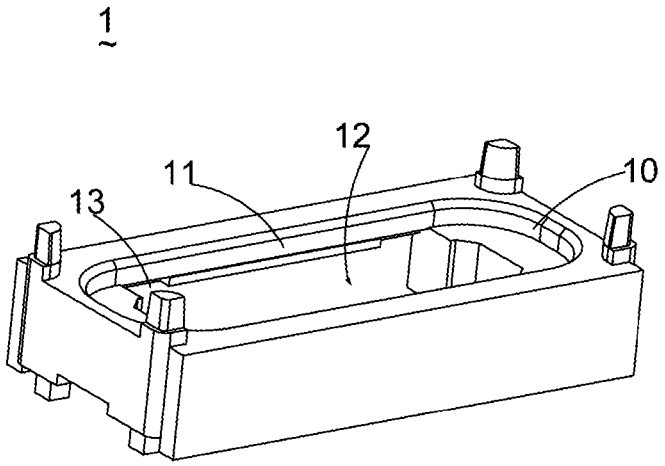
FIG. 2 is an illustrative isometric view of a frame of the electro-acoustic transducer in FIG. 1.

Referring to FIG. 2, the frame 1 includes a pair of first sidewalls 10 arranged opposite to each other and a pair of second sidewalls 11 arranged opposite to each other. Each first sidewall 10 is adjacent to each second sidewall 11. The first and second sidewalls 10,11 are connected with each other one by one, in order from a beginning to an end, to form a receiving space 12. In this embodiment, each second sidewall 11 defines at least one engaging groove 13. Specifically, two engaging grooves 13 are preferred.

Figure 3:
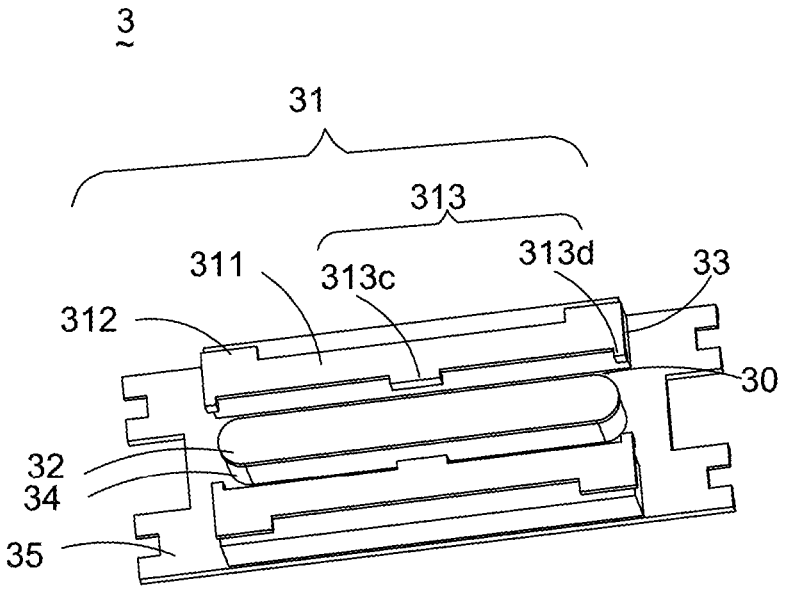
FIG. 3 is an illustrative isometric view of a magnetic circuit unit of the electro-acoustic transducer in FIG. 1.

Referring to FIG. 1 and FIG. 3, the magnetic circuit unit 3 includes a lower plate 35, a main magnet 34 positioned on a central portion of the lower plate 35, a pair of auxiliary magnets 33 mounted on two side portions of the lower plate 35 and positioned spaced from the main magnet 34 for forming a magnetic gap 30, a pole plate 32 attached to a top surface of the main magnet 34, and a pair of upper plates 31 attached to the top surfaces of the auxiliary magnets 33 respectively. Wherein, the upper plates 31 are integrated with the two second sidewalls 11 of the frame 1 by insert-molding. Optionally, the upper plates 31 can also be connected with the frame by other means, such as complementary structures, adhesive, or, soldering.

The pole plate 32 and the upper plate 31 are made from magnetic conductive material, which are capable of conducting the magnetic fluxes produced by the main magnet 34 and the auxiliary magnets 33 and generating more effective magnetic flux density for actuating the voice coil 22.

In the embodiment, the main magnet 34 is cube-shaped. The auxiliary magnets 33 are located adjacent to the longitudinal sides of the main magnet 34, respectively. Each auxiliary magnet 33 includes an inner surface 331 facing the main magnet 34 and an outer surface 332 opposite to the inner surface 331.

The lower plate 35 is made from magnetic conductive material. A bottom surface of the main magnet 34 is attached on the central portion of the lower plate 35 by adhesive or soldering, and bottom surfaces of the auxiliary magnets 33 are attached on two side portions of the lower plate 35 respectively by adhesive or soldering. The lower plate 35 is used for carrying the magnets and conducting magnetic fluxes, therefore, the shape of the lower plate 35 is not limited to that shown in the figure, and could be any possible shape as long as a plane is provided for carrying the magnets.

Figure 4:
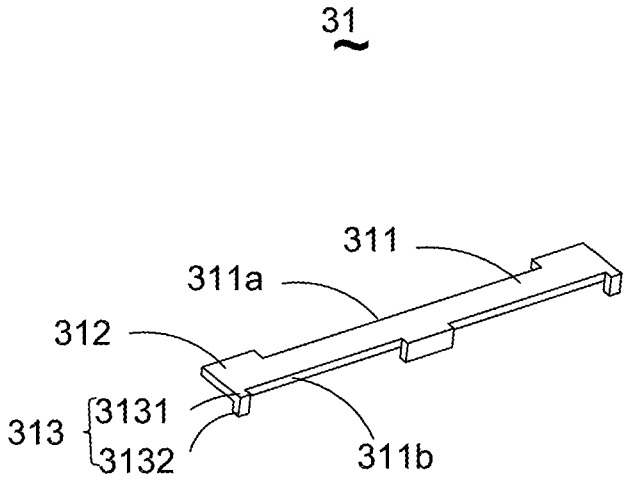
FIG. 4 is an illustrative isometric view of an upper plate of the electro-acoustic transducer in FIG. 1.

Referring to FIG. 3 and FIG. 4, each upper plate 31 includes a base body 311 covering a top surface of a corresponding auxiliary magnet 33 and a restricting part 313 extending from the base body 311 and engaging with the auxiliary magnet 33 for preventing the auxiliary magnet 33 from moving toward the main magnet 34. The base body 311 is integrated with a corresponding second sidewall 11 of the frame 13.

The base body 311 is substantially strip-shaped. The base body 311 includes a first side 311*a* away from the main magnet 34 and a second side 311*b* opposite to the first side 311*a* and facing the main magnet 34. The first side 311*a* is optionally integrated with the second sidewall 11 of the frame 1. The restricting part 313 extends from the second side 311*b*.

The restricting part 313 includes a first portion 3131 protruding from the second side 311*b* horizontally and a second portion 3132 extending from the first portion 311*a* in a direction perpendicularly to the base body 311 and engaging with the inner surface 331 of the auxiliary magnet 33. In other embodiment, the restricting part 313 can only include the second portion 3132 extending from the second side 311*b* in a direction perpendicularly to the base body 311.

In this embodiment, the upper plate 31 further comprises a plurality of restricting parts 313 with same configuration arranged on the second side 311*b* and positioned spaced from each other. All of the restricting parts 313 are divided into a pair of first restricting parts 313*d* positioned on the two ends of the second side 311*b* in a longitudinal direction and a plurality of second restricting parts 313*c* positioned between the two first restricting parts 313*d*. It is possible that the upper plate 31 may has only one restricting part 313. In this embodiment, the restricting part 313, the base body 311 and the second sidewall 11 of the frame 1 are integrated with each other as a whole. In other embodiments, the restricting part 313 may be an individual element connected with the second side 311*b* of the base body 311 by adhesive, soldering, and so on.

The upper plate 31 further comprises a connecting part 312 protruding from the first side 311*a* in a direction toward a corresponding second sidewall 11 and integrated with the sidewall 11. Specifically, there are two connecting parts 312 arranged on the two ends of the first side 311*a* respectively. By virtue of the configuration of the connecting part 312, it can make the upper plate 31 be integrated with the frame 1. Without the connecting part 312, the upper plate 31 can also be connected to the frame 1.

Figure 5:
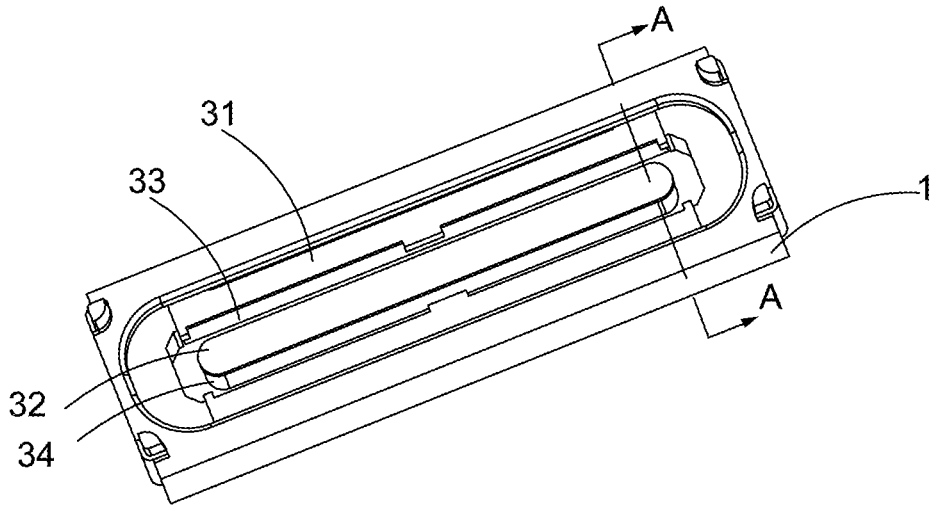
FIG. 5 is an illustrative assembled view showing that the magnetic circuit unit is received in the frame of the electro-acoustic transducer in FIG. 1.
Figure 6:
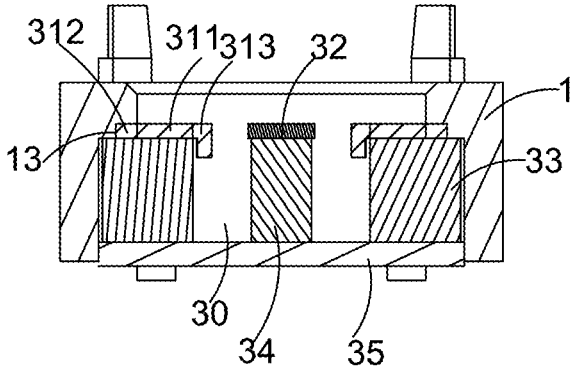
FIG. 6 is a cross-sectional view of the electro-acoustic transducer taken along line A-A of FIG. 5.

As shown in FIG. 5 and FIG. 6, when assembled, the lower plate 35 is received in the receiving space 12 and fixed by the frame 1. The connecting parts 312 of the upper plate 31 are received in the engaging groove 13 of the second sidewall 11 and integrated with the engaging groove 13. The restricting part 313 engages with the inner surface 331 of the auxiliary magnet 33 for preventing the auxiliary magnets 33 from moving toward the main magnet 34. Thus, the auxiliary magnets 33 could be restricted in a proper position. It is obvious that the voice coil 122 is partially received in the magnetic gap 30. When electrified, the voice coil 122 is driven to vibrate by the alternating Lorenz Force generated by the magnetic field in the magnetic gap. The movement of the voice coil 122 activates the diaphragm 121 to vibrate, thereby producing sounds.

Figure 7:
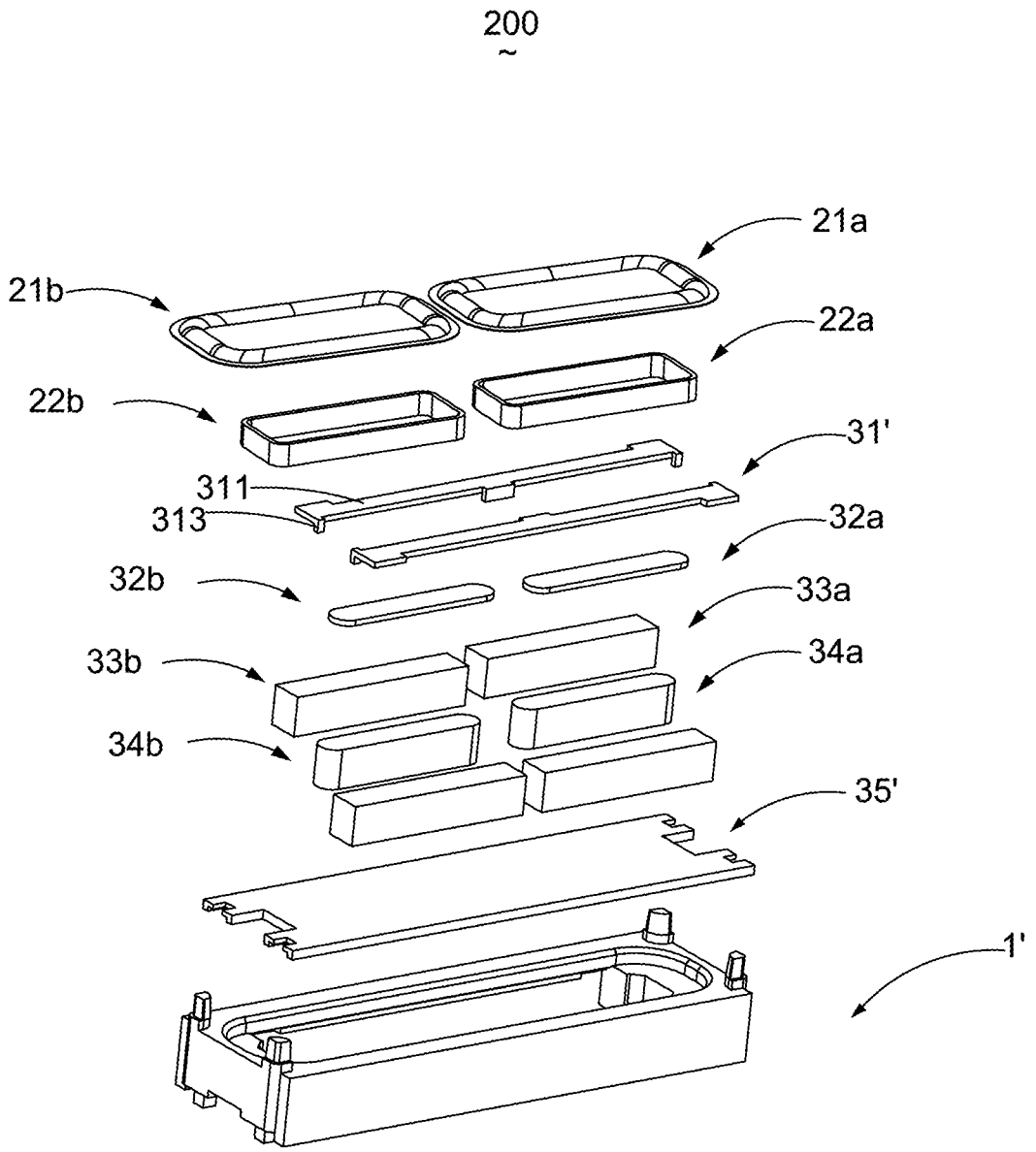
FIG. 7 is an exploded view of an electro-acoustic transducer according to a second embodiment of the present invention.
Figure 8:
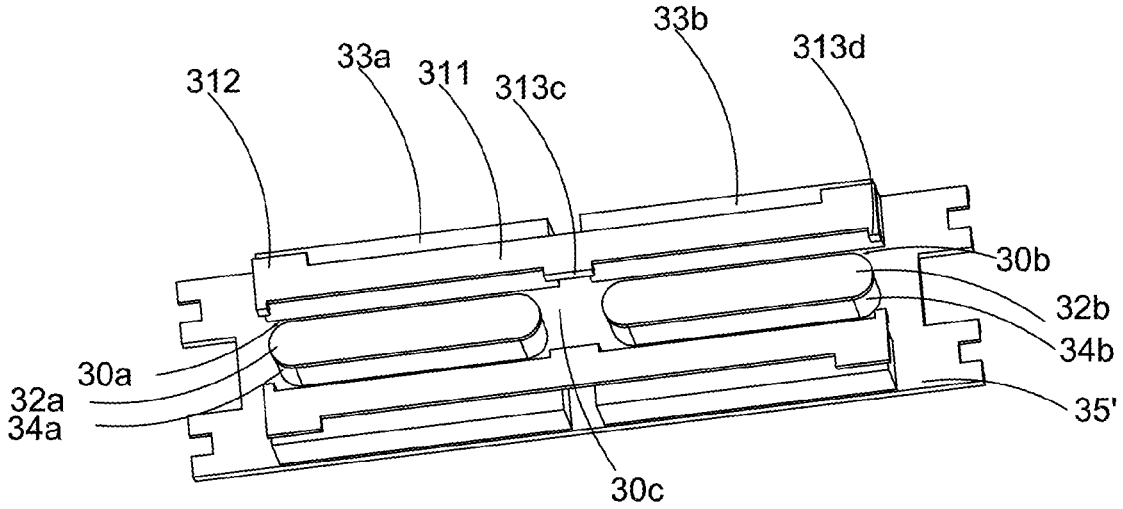
FIG. 8 is an illustrative isometric view of a magnetic circuit unit of the electro-acoustic transducer in FIG. 7.

Referring to FIG. 7 and FIG. 8, an electro-acoustic transducer according to a second embodiment of the present disclosure is shown. In this embodiment, the electro-acoustic transducer 200 has multiple magnets and multiple voice coils and further comprises a frame 1', a vibration unit fixed to the frame 1', and a magnetic circuit unit accommodated in the frame V. The configuration of the frame 1' is same as that of the first embodiment.

In this embodiment, the vibration unit includes a first voice coil 22*a*, a second voice coil 22*b*, a first diaphragm 21*a* connected to the first voice coil 22*a*, and a second diaphragm 21*b* connected to the second voice coil 22*b*. It should be noted that the first and second diaphragms 21*a*, 21*b* may be formed to be an integral unit.

The magnetic circuit unit comprises a lower plate 35', a first main magnet 34*a* and a second main magnet 34*b* attached to a central portion of the lower plate 35' and positioned spaced from each other for forming a first magnetic gap 30*c*, a pair of first auxiliary magnets 33*a* positioned spaced from the first main magnet 34*a* for forming a second magnetic gap 30*a*, a pair of second auxiliary magnets 33*b* positioned spaced from the second main magnet 34*b* for forming a third magnetic gap 30*b*, a first pole plate 32*a* attached on a top surface of the first magnet 34*a*, a second pole plate 32*b* attached on a top surface of the second magnet 34*b* and a pair of upper plate 31' attached on top surfaces of each first auxiliary magnet 33*a* and second auxiliary magnet 33*b* positioned in the same side of the first and second main magnets 34*a*, 34*b*, respectively. Each first auxiliary magnet 33*a* and second auxiliary magnet 33*b* positioned in the same side of the first and second main magnets 34*a*, 34*b* are arranged spaced from each other. The first magnetic gap 30*c*, the second magnetic gap 30*a* and the third magnetic gap 30*b* communicate with each other. It should be noted that the number of the magnets shall not be limited by the second embodiment. The configuration of the lower plate 35' is same to that in the first embodiment. The upper plate 31' includes a base body 311 and a restricting part 313, of which the configuration is same to that in the first embodiment.

The base body 311 attaches on top surfaces of the first and second auxiliary magnets 33*a*,33*b* that are positioned on the same side of the first and second main magnets 34*a*, 34*b*, and is integrated with a corresponding second sidewall of the frame V. The restricting parts 313 engages with the inner surfaces of the first and second auxiliary magnets 33*a*, 33*b*. In this embodiment, the second restricting part 313*c* is arranged at a position where the first auxiliary magnet 33*a* is adjacent to the second auxiliary magnet 33*b*. Specifically, one end of the first auxiliary magnet 33*a* engages with the first restricting part 313*d*, and another end of the first auxiliary magnet 33*a* engages with the second restricting part 313*c*. Accordingly, one end of the second auxiliary magnet 33*b* engages with another first restricting part 313*d*, and another end of the second auxiliary magnet 33*b* engages with the second restricting part 313*c*. By virtue of the configuration of the restricting part 313, the auxiliary magnets 33*a*, 33*b* can be restricted in a proper position, for preventing the auxiliary magnets from conflicting with the voice coils.

It is to be understood, however, that even though numerous characteristics and advantages of the present disclosure have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electro-acoustic transducer, comprising:

a frame defining a plurality of sidewalls for forming a receiving space;

a magnetic circuit unit accommodated in the receiving space, the magnetic circuit unit comprising:

a lower plate;

a main magnet positioned on a central portion of the lower plate;

a pair of auxiliary magnets positioned on two side portions of the lower plate respectively and positioned spaced from the main magnet for forming a magnetic gap, a pair of upper plates, each including a base body attached on a top surface of each auxiliary magnet and integrated with the sidewalls; wherein, the base body comprises a first side away from the main magnet and integrated with the sidewalls, and a second side opposite to the first side; the upper plate comprises a plurality of restricting parts connected with the base body, arranged on the second side, positioned spaced from each other and engaging with an inner surface of the auxiliary magnet facing the main magnet, all of the restricting parts divided into a pair of first restricting parts positioned on two ends of the second side respectively and a plurality of second restricting parts positioned therebetween; and a vibration unit including a voice coil and a diaphragm connected with the voice coil; the voice coil partially received in the magnetic gap.

2. The electro-acoustic transducer of claim 1, wherein the restricting part comprises a first portion protruding from the second side horizontally, and a second portion extending from the first portion in a direction perpendicularly to the base body and engaging with the inner surface of the auxiliary magnet.

3. The electro-acoustic transducer of claim 2, wherein the upper plate further comprises a connecting part protruding from the first side in a direction toward a corresponding sidewall and integrated with the sidewall.

4. The electro-acoustic transducer of claim 3, wherein the frame defines at least one engaging groove.

5. The electro-acoustic transducer of claim 1, wherein the magnetic circuit unit further comprises:

a second main magnet positioned on a central portion of the lower plate and spaced from the main magnet for forming a second magnetic gap;

a pair of second auxiliary magnets positioned spaced from the second main magnet for forming a third magnetic gap; wherein the magnetic gap, the second magnetic gap and the third magnetic gap communicate with each other.

6. The electro-acoustic transducer of claim 5, wherein the vibration unit comprises a first voice coil, a second voice coil, a first diaphragm and a second diaphragm connected with the first and second voice coils respectively; and the first voice coil partially received in the combination of the magnetic gap and the second magnetic gap, and the second voice coil partially received in the combination of the second and third magnetic gaps.

7. An electro-acoustic transducer, comprising:

a frame including a plurality of sidewalls and a receiving space formed by the sidewalls;

a magnetic circuit unit accommodated in the receiving space, the magnetic circuit unit comprising:

a lower plate;

a main magnet positioned on a central portion of the lower plate;

a plurality of auxiliary magnets arranged on the lower plate and forming a magnetic gap cooperatively with the main magnet, a pole plate attached to a top of the main magnet, and a plurality of upper plates corresponding to and attached to the auxiliary magnets; wherein each of the upper plate includes a base portion at least partially embedded in the sidewall of the frame, and a plurality of restricting portions extending from the base portion and engaging with an inner surface of the auxiliary magnet facing the main magnet, wherein, the base portion comprises a first side away from the main magnet and integrated with the sidewalls, and a second side opposite to the first side; a plurality of restricting portions are arranged on the second side and spaced with each other, all of the restricting portions divided into a pair of first restricting portions positioned on two ends of the second side respectively and a plurality of second restricting portions positioned therebetween.

8. The electro-acoustic transducer of claim 7, wherein the restricting portion comprises a first portion protruding from the second side horizontally, and a second portion extending from the first portion in a direction perpendicularly to the base body and engaging with the inner surface of the auxiliary magnet.

9. The electro-acoustic transducer of claim 8, wherein the upper plate further comprises a connecting part protruding from the first side in a direction toward a corresponding sidewall and integrated with the sidewall.

10. The electro-acoustic transducer of claim 9, wherein the frame defines at least one engaging groove.

* * * * *